US007019738B2

(12) United States Patent
Tsutsui

(10) Patent No.: US 7,019,738 B2
(45) Date of Patent: Mar. 28, 2006

(54) DISPLAY DEVICE AND ITS CONTROL METHOD

(75) Inventor: Yusuke Tsutsui, Hashima (JP)

(73) Assignee: Sanyo Electric Co., Ltd., Osaka (JP)

( * ) Notice: Subject to any disclaimer, the term of this patent is extended or adjusted under 35 U.S.C. 154(b) by 543 days.

(21) Appl. No.: 09/953,233

(22) Filed: Sep. 17, 2001

(65) Prior Publication Data

US 2002/0036626 A1 Mar. 28, 2002

(30) Foreign Application Priority Data

Sep. 18, 2000 (JP) ..... 2000-282175

(51) Int. Cl.
*G09G 5/00* (2006.01)

(52) U.S. Cl. ..... 345/211; 345/55; 345/87; 345/98

(58) Field of Classification Search ..... 345/204–205, 345/90, 92, 100, 27, 211–212, 50–52, 87, 345/98

See application file for complete search history.

(56) References Cited

U.S. PATENT DOCUMENTS

| | | | | |
|---|---|---|---|---|
| 5,511,201 | A * | 4/1996 | Kamimaki et al. | 713/310 |
| 5,548,765 | A * | 8/1996 | Tsunoda et al. | 713/322 |
| 5,712,652 | A * | 1/1998 | Sato et al. | 345/90 |
| 5,754,160 | A * | 5/1998 | Shimizu et al. | 345/103 |
| 5,790,090 | A | 8/1998 | Libsch et al. | |
| 5,945,972 | A * | 8/1999 | Okumura et al. | 345/98 |
| 5,952,991 | A | 9/1999 | Akiyama | |
| 5,977,940 | A | 11/1999 | Akiyama et al. | |
| 6,020,879 | A * | 2/2000 | Nakabayashi | 345/212 |
| 6,023,256 | A * | 2/2000 | Ng et al. | 345/51 |
| 6,023,308 | A | 2/2000 | Takemura | |
| 6,072,454 | A | 6/2000 | Nakai et al. | |
| 6,137,481 | A * | 10/2000 | Phillipps | 345/173 |
| 6,246,399 | B1 * | 6/2001 | Yamane et al. | 345/211 |
| 6,262,704 | B1 * | 7/2001 | Kurumisawa et al. | 345/98 |
| 6,333,737 | B1 * | 12/2001 | Nakajima | 345/205 |

FOREIGN PATENT DOCUMENTS

| | | | |
|---|---|---|---|
| EP | 0 797 182 | | 9/1997 |
| EP | 1 020 840 | | 7/2000 |
| JP | 58-23091 | | 2/1983 |
| JP | 06167957 | * | 6/1994 |
| JP | 08-194205 | | 7/1996 |
| JP | 408336162 A | * | 12/1996 |
| JP | 09-236823 | | 9/1997 |
| JP | 9-243994 | | 9/1997 |
| JP | 2000-250494 | * | 9/2000 |
| JP | 2001-242819 | | 9/2001 |
| KP | 2000-18587 | | 4/2000 |

* cited by examiner

*Primary Examiner*—Amr A. Awad
*Assistant Examiner*—Leonid Shapiro
(74) *Attorney, Agent, or Firm*—Morrison & Foerster LLP

(57) ABSTRACT

There is provided a display device which enables both a full color moving image display (analog mode) and a shallow depth still image display (digital mode), and which achieves a significant reduction in the energy consumption of the display device system including the external LSI. Each of the pixel elements of the display device has two different display circuits corresponding to the respective display modes and a switching circuit for selecting one of them. When the digital mode is selected, the supply of the voltage power to the circuits not required to operate (a DA converter, a operational amplifier and a timing controller) under the mode is halted for reducing the consumption of the electric power by the display device.

7 Claims, 6 Drawing Sheets

DISPLAY DEVICE AND ITS CONTROL METHOD

FIELD OF THE INVENTION

This invention relates a display device and its control method, especially to a display device which is incorporated into a portable communication and computing device.

BACKGROUND OF THE INVENTION

There has been a great demand in the market for portable communication and computing devices such as a portable TV and cellular phone. All these devices need a small, light-weight and low-power consumption display device, and development efforts have been made accordingly.

FIG. 6 shows a circuit diagram corresponding to a single pixel element of a conventional liquid crystal display device. A gate signal line 51 and a drain signal line 61 are placed on an insulating substrate (not shown in the figure) perpendicular to each other. A TFT 65 connected to the two signal lines 51, 61 is formed near the crossing of the two signal lines 51, 61. The source 11*s* of the TFT 65 is connected to a pixel electrode 80 of the liquid crystal 21.

A storage capacitor element 85 holds the voltage of the pixel electrode 80 during one field period. One terminal 86 of the storage capacitor element 85 is connected to the source 11*s* of the TFT 65, and the other terminal 87 is provided with a voltage common among all the pixel electrode. When a scanning signal is applied to the gate signal line 51, the TFT 65 turns to an on-state. Accordingly, an analog image signal from the drain signal line 61 is applied to the pixel electrode 80, and the storage capacitor element 85 holds the voltage. The voltage of the image signal is applied to the liquid crystal 21 through the pixel electrode 80, and the liquid crystal 21 aligns in response to the applied voltage for providing a liquid crystal display image. This configuration is capable of showing both moving images and still images. There is a need for the display to show both a moving image and a still image within a single display. One such example is to show a still image of a battery within an area of a moving image of a portable telephone display to show the remaining amount of the battery power.

However, the configuration shown in FIG. 6 requires a continuous rewriting of each pixel element with the same image signal at each scanning in order to provide a still image. This is basically to show a still-like image in a moving image mode, and the scanning signal needs to activate the TFT 65 at each scanning. Accordingly, it is necessary to operate a driver circuit which generates a drive signal for the scanning signals and the image signals, and external LSIs which generates various signals for controlling the timing of the driver circuit, resulting in a consumption of a significant amount of electric power. This is a considerable drawback when such a configuration is used in a portable telephone device which has only a limited power source. That is, the time a user can use the telephone under one battery charge is considerably short.

Japanese Laid-Open Patent Publication No. Hei 8-194205 discloses another configuration for display device suited for portable applications. This display device has a static memory for each of the pixel elements, as shown in FIG. 7. A static memory, in which two inverters INV1 and INV2 are positively fed back to each other, hold the image signal for reducing the power consumption. In this configuration, a switching element 24 controls the resistance between a reference line and a pixel electrode 80 in response to the divalent digital image signal held by the static memory in order to adjust the biasing of the liquid crystal 21. The common electrode, on the other hand, receives an AC signal Vcom. Ideally, this configuration does not need refreshing the memory when the image stays still for a period of time.

As described above, the conventional liquid crystal display device shown in FIG. 6 is suitable for displaying a full color moving image generated by analog signals. On the other hand, the display device equipped with a static memory for holding digital image signals is suitable for displaying a still image with shallow depth and reducing the consumption of the electric power.

Since the two types of the liquid crystal display device need different types of image signal source respectively, there have been no liquid crystal display device capable of showing both a full color moving image and a still image within a single display.

SUMMARY OF THE INVENTION

This invention is directed to a display device and method enabling both a full color moving picture display and a still picture display of low energy consumption in a single display device, for example, one liquid crystal display panel. This invention is also directed to a reduction of the consumption of the electric power by the entire display system including external LSIs disposed outside of the display system.

According to this invention, there is provided a display device having a plurality of gate signal lines disposed in a predetermined direction on a substrate, a gate driver for sequentially feeding scanning signals to the gate signal lines, and a plurality of drain signal lines disposed in a direction perpendicular to the predetermined direction. The device also includes a drain driver which sequentially selects one of the drain signal lines and feeds an image signal to the selected drain signal line, a timing control circuit which feeds a timing control signal to the gate driver, the drain driver or both of the drivers, and a plurality of pixel electrodes which are disposed as a matrix. There are provided two display circuits for each of the pixel electrodes in the device. The first display circuit successively provides the pixel electrode with the image signals successively inputted, and the second display circuit includes a retaining circuit holding the image signal and provides the pixel electrode with an voltage corresponding to the image signal retained by the retaining circuit. There is also provided in the device a circuit selection circuit for selecting one of the first and second display circuits and a control circuit which halts a supply of a power voltage to a predetermined circuit not required to operate when the circuit selection circuit selects the second display circuit. When the second display circuit is selected, some of the circuits which are required to operate when the first display circuit is selected do not have to operate. Therefore, by simply halting the supply of power voltage to those circuits while the second display circuit is selected, it is possible to save a significant amount of electric power consumed by the display device.

Those circuits not required to operate when the second display circuit is selected includes a DA converter circuit which converts a digital image signal inputted to an analog image signal, an amplifying circuit for amplifying an analog image signal, and the gate driver or the drain driver. Most of these circuits consume relatively larger amount of energy, the effect of shutting down these circuits amounts to significant energy savings.

The timing control circuit of the display device generates a first AC drive signal fed to a common electrode of an display panel of the display device. The display device further includes an oscillator which generates a second AC drive signal of a frequency lower than a frequency of the first drive signal, and a switching circuit for switching the first AC drive signal to the second AC drive signal when the circuit selection circuit selects the second display circuit. An AC drive signal must be applied to the common electrode for preventing deterioration of the liquid crystal. When the second display is selected (digital mode), the frequency of the AC drive signal can be lower than the frequency of the AC drive signal while the first display is selected (analog mode) because the flickering of the display is not an issue under a digital mode. Thus, by lowering the frequency of the AC drive signal under the digital mode, it is possible to further reduce the consumption of the electric power. In this regard, it is preferable that the second AC drive signal have a period longer than a vertical period of the display device.

Furthermore, by halting the supply of the power voltage to the timing control circuit when the second display circuit is selected, it is possible to further reduce the consumption of the electric power. Because another oscillator is provide for generating the second AC driving signal, turning off the timing controller does not pose any problem.

DETAILED DESCRIPTION OF THE INVENTION

Figure 1:
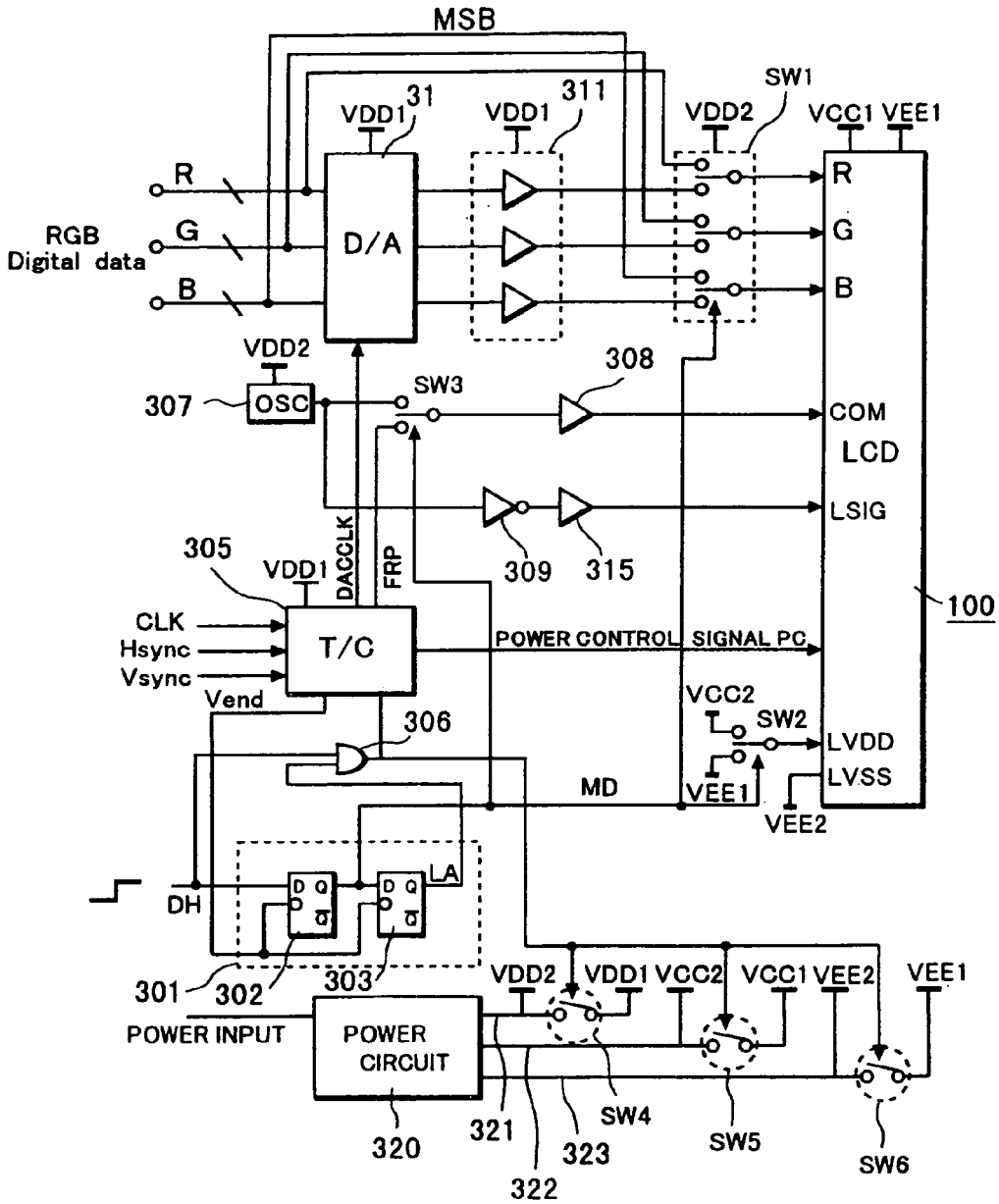
FIG. 1 is a circuit diagram of a liquid crystal display device of an embodiment of this invention

FIG. 1 shows a circuit diagram of a liquid crystal display device of an embodiment of this invention.

DFF(Delayed Flip-Flop) 301 has two flip-flop circuits 302, 303. When a display mode change signal DH, which is provided to the flip-flop 302, turns to a high-level (H), the flip-flop 305 outputs a mode change signal MD in synchronization with a vertical period end signal Vend fed from a timing controller 305.

The flip-flop 303, then, outputs a control signal LA at the next vertical period end signal Vend. The mode change signal MD and the control signal LA control operations of various circuits as described below.

The timing controller 305, in accordance with a system clock CLK, a horizontal synchronizing signal Hsync, and a vertical synchronizing signal Vsync, outputs a panel control signal PC, the vertical period end signal Vend, an AC drive signal FRP for alternatively driving through a common electrode the liquid crystal contained in a display panel 100, and a drive clock provided to a DA converter 310. The panel control signal PC includes a horizontal start pulse STH and a vertical start pulse STV which in a combination trigger panel scanning signals.

AND gate 306 outputs a signal to halt the operation of the timing controller 305. The AND gate 306 receives the control signal LA and the display mode change signal DH. Accordingly, the timing controller 305 stops its operation when both input signals to the AND gate 306 are H (under digital display mode). When the display mode change signal DH change to L, the timing controller 305 resumes its operation (under analog display mode).

An oscillator 307 is provided as a unit operating independently from the timing controller 305. This timing controller 305 operates as a signal source of the AC drive signal under the digital display mode, and the AC drive signal has a period longer than the signal period of the AC drive signal FRP fed from the timing controller 305, which is usually equal to a one horizontal period.

The circuit configuration under the digital mode, as described below, has a static retaining circuit to hold the digital image signal, according to which the signals applied to the pixel electrodes is selected. This eliminates the decay of the image signal due to the leaking of the storage capacitor element 85, as observed under the analog mode, and makes it possible to employ an AC drive signal of a relatively low frequency. For the purposes of reducing the energy consumption, it is preferable that the signal period be longer than a single vertical period (60 Hz).

A switching circuit SW3 alternates, in response to the mode change signal MD, the output signal of the oscillator 307 and the AC drive signal FRP fed from the timing controller 305. A operational amplifier 308 amplifies the selected signal and feeds the signal to a common electrode terminal COM. The output signal of the oscillator 307 is also fed to an inverter circuit 309 for inverting its phase and then fed to a signal terminal LSIG after amplified by an operational amplifier 315. This pair of signals of opposite phases is used for displaying a black and white image under the digital mode, as described below.

A DA converter 310 converts R, G, B digital image signals provided from outside to analog image signals. Each of the R, G, B digital image signals has an eight-bit depth. The most significant bit (MSB) of the image signal data and the analog image signals after the DA conversion and the amplification are fed to a switching circuit SW1, which selects one of the two signals in accordance with the mode change signal MD and feeds the selected signal to the R, G, B terminals of the display panel 100.

In this embodiment, the retaining circuit for holding digital image signals in the display panel 100 holds information corresponding to one bit depth, as described below.

This is why only the most significant bit is outputted. However, it is possible to output a multi-bit digital image signals if the retaining circuit is modified to hold multiplebit image data.

A switching circuit SW2 outputs, in response to the mode change signal MD, a H signal or L signal to a terminal LVDD of the display panel 100. Based on this input signal, the display panel 100 changes the display mode between the analog display mode (LVDD=L) and the digital display mode (LVDD=H).

A electric power circuit 320 generates based on the input power source power voltages VDD1, VDD2 (for example, 5 V), VCC1, VCC2 (for example 8–10 V), and VEE1, VEE2 (for example −4 to −5 V). The output lines 321, 322, 323 of the electric power circuit 320 are connected to switching circuits SW4, SW5, SW6 respectively, which controls the supply of the electric power VDD1, VCC1 and VEE1 in response to the output signal from the AND gate 306. When the output of the AND gate 306 changes to H, the switching circuits SW4, SW5, SW6 operate to halt the electric power supply to the DA converter 310, the operational amplifier 311 and the timing controller 305, which receive electric power voltages VDD1, VCC1, VEE1, respectively.

Figure 2:
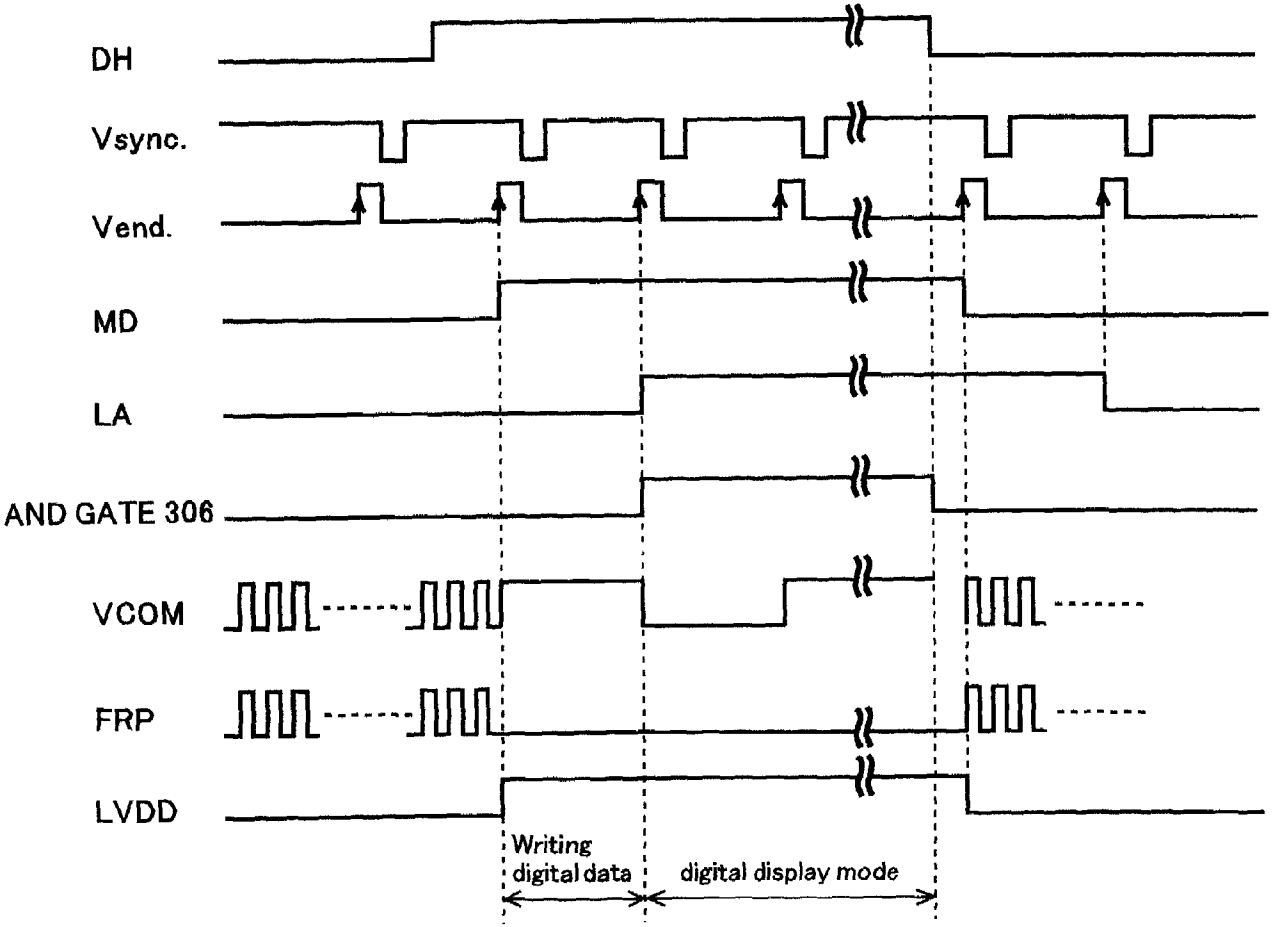
FIG. 2 is a timing chart of the liquid crystal display device of FIG. 1.

The operation of the display device having the configuration above will be described below in reference to the timing chart shown in FIG. 2. When the display mode change signal DH changes to H, the mode change signal MD changes to H at the onset of the next vertical period end signal Vend, which turns on at the end of a vertical period.

Then, the switching circuit SW2 changes the LVDD terminal to H, which changes the display panel 100 to a digital display mode. At the same time, the switching circuit SW1 operates so that the most significant bit of the digital signal data is outputted to the R, G, B terminals. Furthermore, the switching circuit SW3 changes the AC drive signal applied to the common electrode terminal COM to the signal of low frequency. Thus, after one vertical period (the period between the two Vend signals), a digital image is written in a field of the display panel 100.

The control signal LA turns on, at the onset of the next vertical period end signal Vend after the one vertical period for the image writing. The output of the AND gate 306, then, changes to H, and the timing controller 305 stops its operation based on the signal change, resulting in holding the various panel control signals PC and output signals including an operation clock DACCLK. The signal change also stops the operation of the DA converter 310.

In response to the change of the out put of the AND gate 306, the switching circuits SW4, SW5, SW6 opens and halts the supply of the power voltage to the DA converter 310, the operational amplifier 311, the timing controller 305, and the internal drivers in the display panel 100.

The digital display mode of this embodiment does not only halt the operation of the circuits not required to operate during the mode, but also halts the supply of the power voltage to those circuits. This results in a significant reduction of the electric power consumption, and is capable of reducing the consumption to a one fifth of the energy consumption when the only the operation of the circuits are halted.

In order to return to the analog display mode, first, the display mode change signal DH changes to L. Accordingly, the output of the AND gate 306 changes to L and the timing controller 305 resumes the operation. When the mode change signal MD turns to L at the onset of the vertical period end signal Vend, the switching circuit SW1 operates to output analog image signal fed from the DA converter 310. At the same time, the switching circuit SW3 operates so that the AC drive signal FRP fed from the timing controller 305 is applied to the terminal COM. Furthermore, the switching circuit SW2 operates to select VEE to return to the analog display mode.

When the output of the AND gate 306 changes to L, the switching circuits SW4, SW5, SW6 close and the supply of the power voltage resumes to the DA converter 310, the operational amplifier 311, the timing controller 305 and the internal drivers in the display panel 100. The control signal LA changes to L at the onset of the next vertical period end signal Vend. Thus, the display panel 100 returns to the analog display mode.

Figure 3:
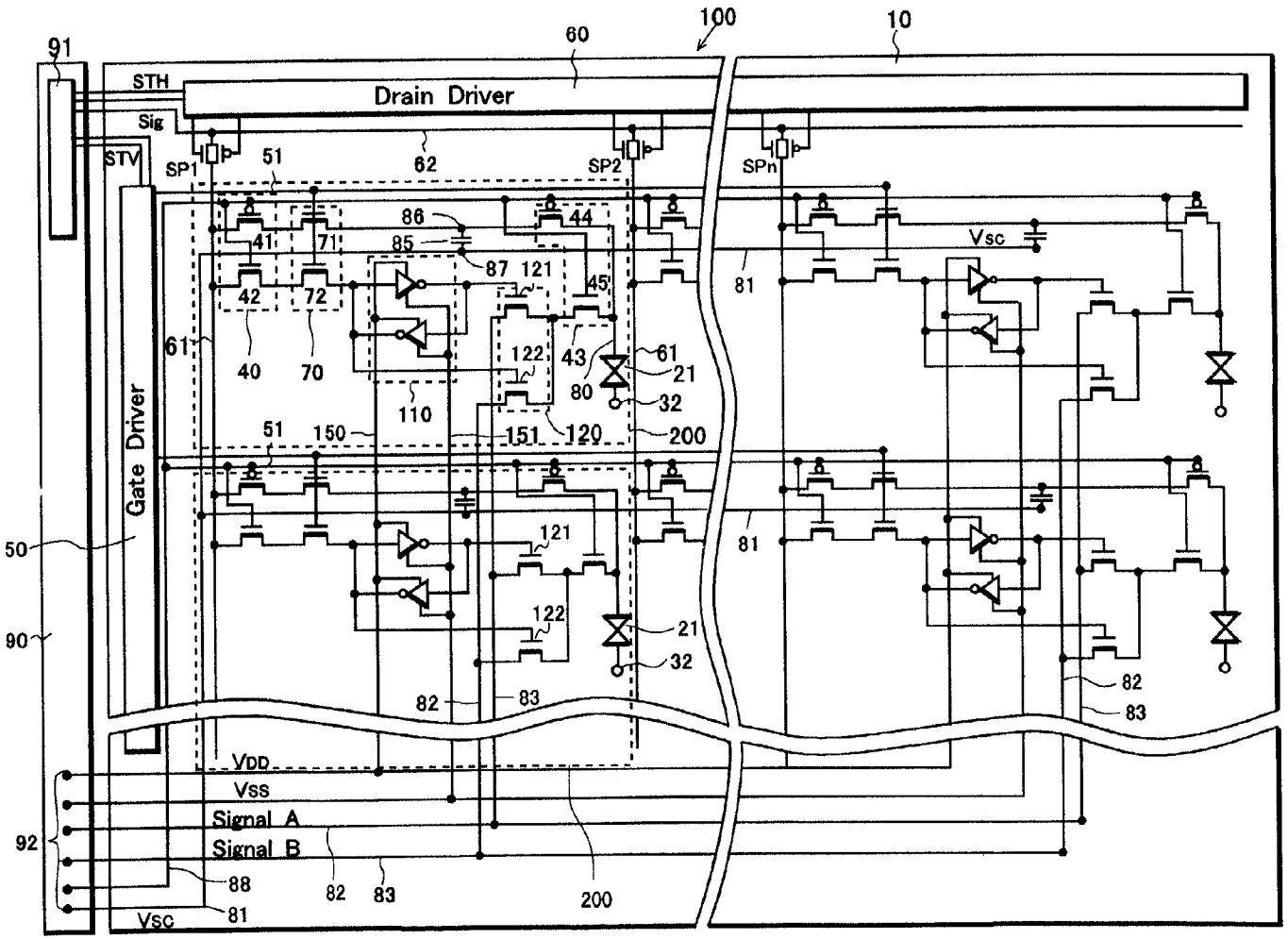
FIG. 3 is a circuit diagram relating to the pixel element of the liquid crystal display device of FIG. 1.

In the followings, the circuit configuration of the display panel 100 will be described in detail in reference to FIG. 3. A plurality of the gate signal lines 51 connected to a gate driver 50 for providing scanning signals are aligned in one direction on a insulating substrate 10. A plurality of drain signal liens 61 are aligned on the insulating substrate 10 in a direction perpendicular to the direction of the gate signal lines 51.

Sampling transistors SP1, SP2, . . . , Spn turn on in response to the timing of the sampling pulse fed from the drain driver 60, and connect the drain signal lines 61 to the data signal lines 62 carrying the data signal, which is the digital image signal or the analog image signal controlled by the switching circuit SW1 provided outside of the display panel 100.

The display panel 100 consists of a plurality of pixel elements 200 provided in a matrix configuration. These pixel elements 200 are elected by the scanning signal fed from the gate signal lines 51 and receive the data signal fed from the drain signal line 61.

A circuit selection circuit 40 having a P-channel TFT 41 and a N-channel TFT 42 is placed near the crossing of the gate signal lien 51 and the drain signal line 61. The drains of TFTs 41, 42 are connected to the drain signal line 61 and the gates of the two TFTs are connected to selection signal line 88. One of the two TFTs 41, 42 turns on in response to a selection signal fed from the selection signal line 88, which is connected to the terminal LVDD of the display panel 100. The selection signal line 88 is connected to the LVDD terminal of the display panel 100. As decried below, a similar circuit selection circuit 43 is provided to cooperate with the circuit selection circuit 40.

A pair of the two circuit selection circuits 40, 43 enables the switching between the analog image display (full color moving image) and the digital image display (still image and low energy consumption). A pixel element selection circuit 70 having a N-channel TFT 71 and a N-channel TFT 72 is placed next to the circuit selection circuit 40. The TFTs 71, 72 are connected to the TFTs 41, 42 of the circuit selection circuit 40 in series, as shown in FIG. 3, and both gates of the TFTs 71, 72 are connected to the gate signal line 51. Both of the TFTs 71, 72 turn on at the same time in response to the scanning signal fed from the gate signal line 51.

A storage capacitor element 85 hold the analog image signal in the analog mode. One of the electrode 86 of the storage capacitor element 85 is connected to the source 71*s* of the TFT 71. Another electrode 87 is connected to a common storage capacitor line 88 carrying a bias voltage VCS. In the analog mode, when the analog image signal is applied to the liquid crystal 21 after the opening the TFT gates of the circuit selection circuit 70, the voltage of the applied signal reduces even during a one field period, resulting in a loos of the homogeneity of the displayed image. The storage capacitor element 85 maintains the applied voltage at the initial level during one field period for eliminating the problem above.

A P-channel TFT 44 of the circuit selection circuit 43 is placed between the storage capacitor element 85 and the liquid crystal 21, and turns on and off in synchronization with the switching of the TFT 41 of the circuit selection circuit 40.

A retaining circuit 110 and a signal selection circuit 120 are placed between the TFT 72 of the pixel element selection circuit 70 and the pixel electrode 80 of the liquid crystal 21. The retaining circuit 110 has two inverter circuits which are positively fed back to each other, and forms a static memory of digital divalent.

The signal selection circuit 120 has two N-channel TFTs 121, 122, and selects a signal in response to the signal fed from the retaining circuit 120. Since two complementary output signals from the retaining circuit 110 are applied to the gates of the two TFTs 121, 122, respectively, only one of the two TFTs 121, 122 turns on at a time.

The AC drive signal (signal A) is selected when the TFT 122 turns on, and the common electrode signal Vcom (signal B) is selected when the TFT 121 turns on. The selected signal is then applied to the display signal 80 of the liquid crystal 21 through the TFT 45 of the circuit selection circuit 43. The common electrode signal Vcom (signal A) is the signal generated by the oscillator 307, and the AC drive signal (signal A) is an inverted signal of the signal generated by the oscillator 306.

In summary, a single pixel element 200 of the display device of this invention has a first circuit having a display selection element (TFT 71) and a storage capacitor element 85 for holing an analog image signal, and a second circuit having a display selection element (TFT 72), a retaining circuit 110 to hold a divalent digital image signal and a signal selection circuit 120. The signal pixel element 200 also has circuit selection circuits 40, 43 for selecting one of the above two circuits.

The liquid crystal display panel 200 has peripheral circuits as well. A panel drive LSI 91 is mounted on an external circuit board 90 fitted to the insulating substrate 10 of the liquid crystal panel 200, and sends the vertical start signal STV and the horizontal start signal STH to the gate driver 50 and the drain driver 60, respectively. The panel driver LSI also feeds the image signal to the data line 63. This panel drive LSI corresponds to the timing controller 305 shown in FIG. 1.

Figure 4:
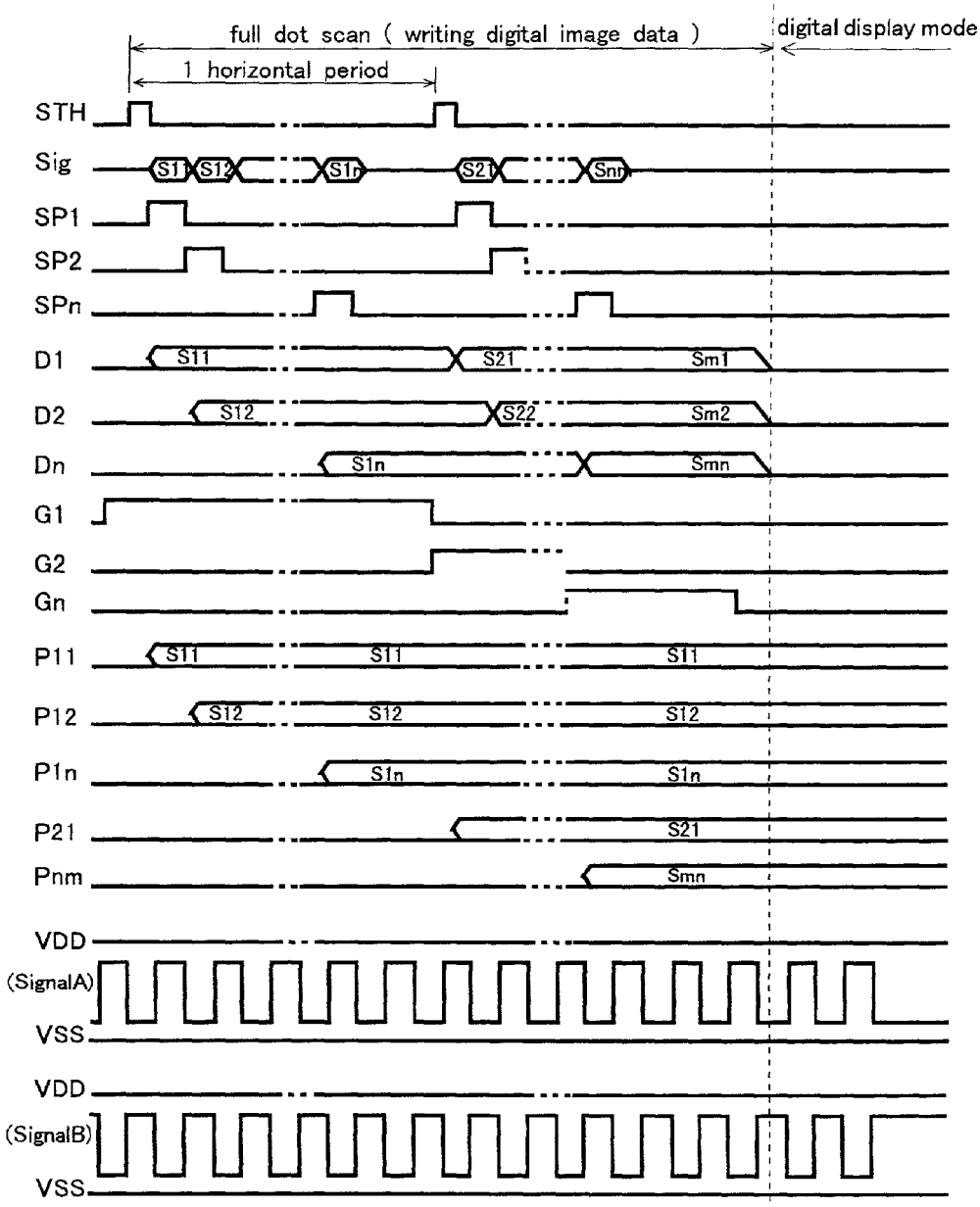
FIG. 4 is a timing chart of the liquid crystal display device of FIG. 1 under a digital mode.

A driving method of the display panel having the configuration above will be described below in reference to FIGS. 1–4. FIG. 4 shows a timing chart when the liquid crystal device is set to operate under the digital display mode.

(1) Analog Display Mode

The analog display mode is selected in response to the display mode selection signal MD (in this case L). Then, the switching circuit SW1 operates to output the analog image signal to the data line 62, and the voltage applied on the circuit selection signal line 88 changes to L so that the TFTs 41, 44 of the circuit selection circuits 40, 43 turn on.

The sampling transistor SP turns on in response to the sampling signal based on the horizontal start signal STH so that the analog image signal is provided to the drain signal line 61 through the data signal line 62.

The scanning signal is provided to the gate signal line 51 in accordance with the vertical start signal STV. When the TFT 71 turns on in response to the scanning signal, the analog image signal Sig is applied, through the drain signal line 61, to the pixel electrode 80 and the storage capacitor element 85, which hold the applied voltage. The liquid crystal 21 rearrange itself in accordance with the image signal voltage applied to the liquid crystal 21, resulting in a displayed image.

This analog display mode is suitable for showing a full color moving image because the image signal voltage is successively inputted. However, the external LSI 91 on the external circuit board 90, and drivers 50, 60 continuously consume the electric power for driving the liquid crystal display device.

(2) Digital Display Mode

When the digital display mode is selected in response to the mode signal change signal MD (H), the data signal line 62 is set to receive the digital image signal. At the same time, the voltage of the circuit selection signal line 88 turns to H, and the retaining circuit 110 is set to be operable. Further, the TFTs 41, 44 of the circuit selection circuits 40, 43 turn off and the TFTs 41, 44 of the circuit turn on.

The panel drive LSI 91 (the timing controller 305) on the external circuit board 80 sends start signals STV, STH to the gate driver 50 and the drain driver 60. In response to the start signals, sampling signals are sequentially generated and turn on the respective sampling transistors SP1, SP2, . . . , SPn sequentially, which sample the digital image signal Sig and send it to each of the drain signal lines 61.

Now, the operation of the first row of the matrix, or the portion of the circuit connected to the gate signal line 51 which receives the scanning signal G1, will be described below. First, the scanning signal GI turns on each TFT of the pixel elements (P11, P12, . . . , P1n) connected to the gate signal line 51, for one horizontal scanning period.

In the pixel element P11 located at the upper left corner of the matrix, the sampling transistor SP1 takes in the digital signal S11 and feeds it to the drain signal line 61. The TFT 72 turns on in response to the scanning signal G1, and the retaining circuit 110 holds the 11 drain signal D1.

The signal retained by the retaining circuit 110 is then fed to the signal selection circuit 120, and is used by the signal selection circuit 120 to select one of the signal A and signal B. The selected signal is then applied to the liquid crystal 21 through the pixel electrode 80.

Thus, after a completion of a scanning from the first gate signal line 51 on the top row of the matrix to the last gate signal line 51 on the bottom row of the matrix, a full display frame scan (one field scan), or full dot scanning, is completed and the digital signals are written in each of the pixel element. As a result, the display device shows an image corresponding to the digital image signals retained by the retaining circuit 110.

Once this image is displayed, the control circuit LA halts the supply of the power voltage to the circuits not required to operate during the digital mode such as the gate driver 50, the drain driver 60 and the external panel drive LSI 91 (the timing controller 305).

During this mode, the retaining circuit 110 receives the voltages Vdd, Vss as power voltages at any time, the common electrode 32 of the liquid crystal 21 revives the low frequency AC drive signal Vcom (for example, of 60 Hz), and the selection circuit 120 receives the signal A and the signal B. In the configuration of FIG. 3, when the liquid crystal display panel 100 is in a normally-white (NW) mode, the signal A is the AC drive signal Vcom, which is the same signal applied to the common electrode 32, and the signal B is the signal having a phase opposite to and the same amplitude as the signal A.

When the retaining circuit 110 receives the digital image signal of H through the drain signal line 61, the first TFT 121 of the signal selection circuit 129 receives a L signal and accordingly turns off, and the second TFT 122 receives a H signal and turns on.

In this case, the signal B is selected and the pixel electrode 80 of the liquid crystal 21 receives the signal B having a phase opposite to the signal A applied to the common electrode 32, resulting in the rearrangement of the liquid crystal 21. Since the display panel is in a NW mode, a black image results.

When the retaining circuit 110 receives the digital image signal of L through the drain signal line 61, the first TFT 121 of the signal selection circuit 129 receives a H signal and accordingly turns on, and the second TFT 122 receives a L signal and turns off.

In this case, the signal A is selected and the pixel electrode 80 of the liquid crystal 21 receives the signal A, which is the same as the signal A applied to the common electrode 32. As a result, there is no change in the arrangement of the liquid crystal 21 and the pixel element stays white.

In this digital mode, first, the signals corresponding to one filed are written in the retaining circuits 110, and, then, a still image is displayed based on the signals retained by the retaining circuit 110. Thus, it is possible to significantly reduce the amount of the electric power consumed by the liquid display device by halting the supply of the power voltage to the driver circuits 50, 60 and the external LSI 91.

It is preferable that the display device of this invention be applied to a liquid crystal display device, especially to a reflection-type liquid crystal display device. A device structure of a reflection-type liquid crystal display device will be described below in reference to FIG. 5.

The element denoted by the reference numeral 10 is a insulating substrate on one side of the display device, and the element denoted by the reference numeral 11 is an isolated polysilicon semiconductor layer 11 on the substrate 10. A gate insulating film 12 is formed on top of the polysilicon semiconductor layer 11, and a gate electrode 13 is formed on the portion of the insulating film 12 corresponding to the polysilicon semiconductor layer 11.

Figure 5:
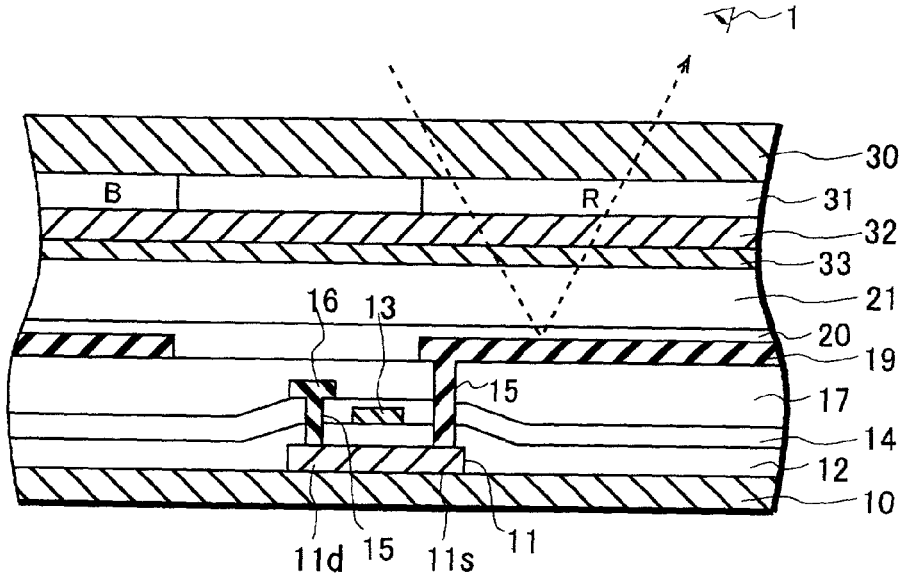
FIG. 5 is a cross-sectional view of a reflection-type liquid crystal display device.
Figure 6:
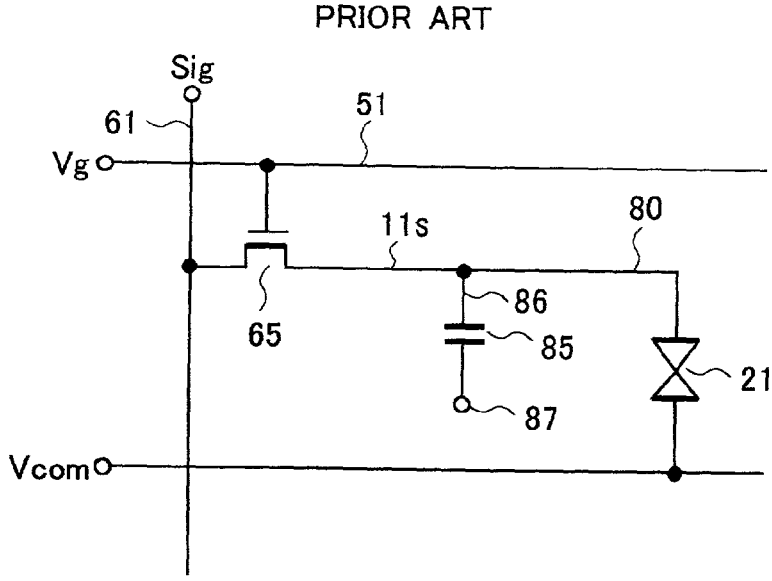
FIG. 6 is a circuit diagram of a conventional liquid crystal display device.
Figure 7:
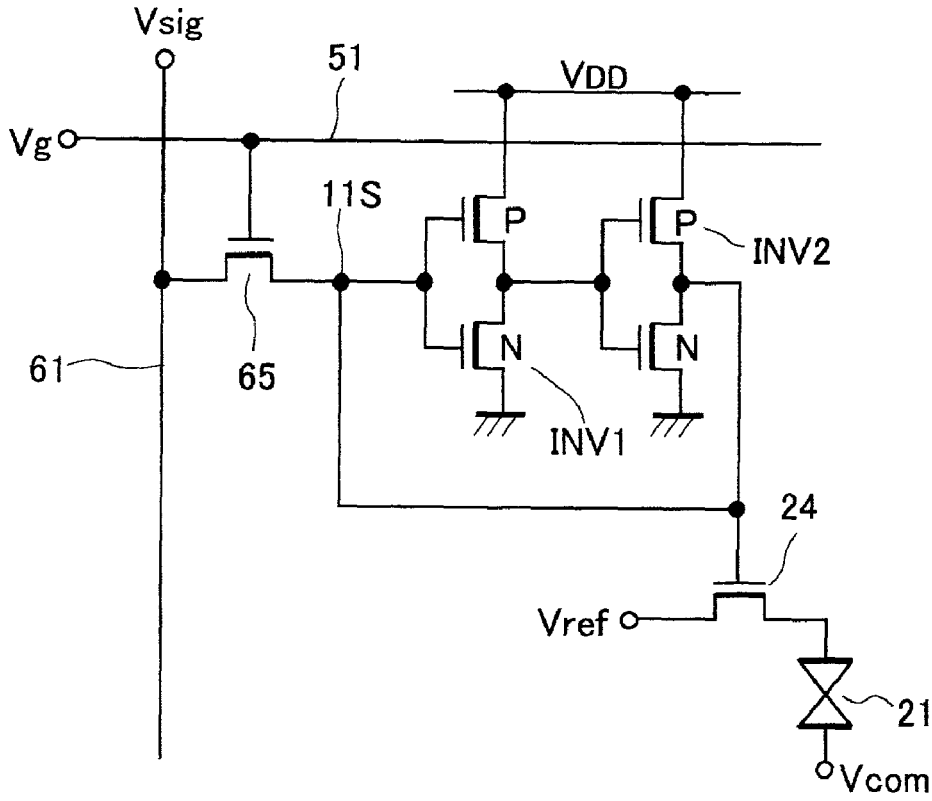
FIG.7 PRIOR ART
FIG. 7 is a circuit diagram of another conventional liquid crystal display device.

A source 11*s* and a drain 11*d* are formed in the semiconductor layer 11 at the portions located at both sides of the gate electrode 13, as shown in FIG. 5. An interlayer insulating film 14 is deposited above the gate electrode 13 and the gate insulating layer 12. Contact holes 15 are formed at the portions of the interlayer insulating film 14 corresponding to the drain 11*d* and the source 11*s*. The drain 11*d* is connected to a drain electrode 16 through the contact hole 15, and the source 11*s* is connected to a pixel electrode 19 through the contact hole 15 piercing through the interlayer insulating film 14 and a flattening insulating film 17 formed on the interlayer insulating film 14.

The pixel electrode 19 is formed on the flattening insulating film 17 and is made of a reflecting electrode material, for example, an aluminum (Al). An orientation film 20 is formed on the pixel electrode 19 and the portions of the flattening insulating film 17 not covered by the pixel electrode 19. The orientation film 20 is made of polyimide and aligns the liquid crystal 21.

The insulating substrate 30 on the other side of the display device has color filters 31 for generating red (R), green (G) and blue (B) colors, a common electrode 32 made of a transparent electrode material such as ITO (indium tin oxide), and an orientation film 33 for aligning the liquid crystal 21.

The liquid crystal 21 fills the gap between the two insulating substrates 10, 30, which are attached together by sealing the peripheral portions of the two insulating substrates with an sealing adhesive such that there is a predetermined space for the liquid crystal 21 between them.

As shown in FIG. 5, the light coming from the side of an observer 1 through the common electrode 32 and incident on the pixel electrode 19 is reflected by the pixel electrode 19 so that the observer 1 recognizes the light modulated by the liquid crystal 21 of the display device.

In this configuration, the display device utilizes the lights external to the device and does not need an internal light source such as the one known as a back light in the transmitting-type liquid crystal display. By applying the display device of this invention to the reflection-type liquid crystal display device, it is possible to further reduce the consumption of the electric power since there is no need for the internal light source consuming the electric power in the reflection-type display device.

In the embodiment described in reference to FIGS. 1 through 4, the voltage to the common electrode and the signals A and B are applied to the respective terminals throughout one full dot scan period of a field. The display device of this invention is not limited to that embodiment, and includes a configuration in which those voltages are not applied throughout the scan. Such a configuration is preferable because of a further reduction of the consumption of the electric power by the display device.

Furthermore, in the above embodiment, one bit digital data signal is used in the digital display mode. The display device of this invention is not limited to that embodiment, and is also applied to a multiple bit digital data signal system in which a multiple level image representation is possible. In this configuration, the retaining circuits and the signal selection circuits are provided in accordance with the number of the bits used in the system.

Still furthermore, in the above embodiment, only a portion of the liquid display panel is used for displaying the still image. The display device of this invention is not limited to that embodiment, and the still image may be displayed in the entire area of the display panel.

Furthermore, in the above embodiment, the reflection-type liquid crystal display device is used. The display device of this invention is not limited to that embodiment, and is applied to the transmitting-type liquid crystal display device. In that case, the pixel electrode is made of a transparent electrode material, rather than a reflecting electrode material, at least in the area of the pixel element including portions corresponding to the TFTs, the retaining circuit, signal selection circuit and the signal wiring.

According to this invention, a single display panel provides two different display modes, the analog display mode for a full color moving image and the digital display mode for reducing the electric power consumption. When the display device is under the digital mode, the circuits not required to operate under the mode stop the operation and the supply of the power voltage to those circuits are halted. Accordingly, a significant reduction in the energy consumption of the whole display device is achieved.

When the display device of this invention is used in a portable TV or a portable telephone, which carries only a limited battery source, the low energy consumption of the display device of this invention leads to an extended use of such portable devices.

The above is a detailed description of particular embodiments of the invention. It is recognized that departures from the disclosed embodiments may be made within the scope of the invention and that obvious modifications will occur to a person skilled in the art. The full scope of the invention is set out in the claims that follow and their equivalents. Accordingly, the claims and specification should not construed to narrow the full scope of protection to which the invention is entitled.

What is claimed is:

1. A display device comprising:

a plurality of gate signal lines disposed in a predetermined direction on a substrate;

a gate driver for feeding scanning signals to the gate signal lines;

a plurality of drain signal lines disposed in a direction different from the predetermined direction;

a drain driver which selects at least one of the drain signal lines and feeds an image signal to the selected drain signal lines;

a timing control circuit which feeds a timing control signal to the gate driver, the drain driver or both of the drivers;

a plurality of pixel electrodes which are disposed as a matrix, selected by the scanning signals fed through the gate signal lines and provided with the image signal fed through the drain signal lines;

a first display circuit which is provided for the pixel electrodes and provides a corresponding pixel electrode with the image signal;

a second display circuit which is provided for the pixel electrodes, includes a retaining circuit holding the image signal and provides a corresponding pixel electrode with an voltage corresponding to the image signal held by the retaining circuit;

a circuit selection circuit for selecting one of the first and second display circuits; and a control circuit which halts a supply of a power voltage to a predetermined circuit required to operate the first display circuit after the circuit selection circuit selects the second display circuit, wherein the control circuit comprises a delay circuit which delays an display mode change signal inputted from outside of the device in accordance with a vertical period end signal and generates a halt signal and a gate circuit which receives the display mode change signal and the halt signal, and wherein an output signal from the gate circuit holts the supply of the power voltage to the predetermined circuit.

2. The display device of claim 1, wherein the predetermined circuit is a DA converter circuit which converts a digital image signal inputted to an analog image signal.

3. The display device of claim 1, wherein the predetermined circuit is an amplifying circuit for amplifying an analog image signal.

4. The display device of claim 1, wherein the predetermined circuit is the gate driver or the drain driver.

5. The display device of claim 1, further comprising an oscillator and a switching circuit, wherein the timing control circuit generates a first AC drive signal fed to a common electrode of an display panel of the display device, the oscillator generates a second AC drive signal of a frequency lower than a frequency of the first drive signal, said second AC drive signal being fed to the common electrode, and the switching circuit switches the first AC drive signal to the second AC drive signal when the circuit selection circuit selects the second display circuit.

6. The display device of claim 5, wherein the second AC drive signal has a period longer than a vertical period of the display device.

7. The display device of claim 1, wherein the predetermined circuit is the timing control circuit.

* * * * *